United States Patent [19]

White

[11] 4,372,221

[45] Feb. 8, 1983

[54] FOLDING PALLET

[75] Inventor: Herbert V. White, Borger, Tex.

[73] Assignee: J. M. Huber Corporation, Locust, N.J.

[21] Appl. No.: 135,411

[22] Filed: Mar. 31, 1980

[51] Int. Cl.[3] ..... B65D 19/20

[52] U.S. Cl. ..... 108/51.3; 108/55.3

[58] Field of Search ..... 108/51.3, 56.1, 56.3, 108/55.3, 55.1; 206/386, 596, 598-600; 248/152, 174

[56] References Cited

U.S. PATENT DOCUMENTS

| | | | |
|---|---|---|---|
| 2,928,578 | 3/1960 | Parker | 108/51.3 X |
| 2,957,668 | 10/1960 | Norquist et al. | 108/51.3 |
| 3,246,824 | 4/1966 | Gardner | 108/51.3 X |
| 3,934,805 | 1/1976 | Elaschuk | 108/51.3 X |

FOREIGN PATENT DOCUMENTS

| | | | |
|---|---|---|---|
| 1189458 | 3/1965 | Fed. Rep. of Germany | 105/51.3 |
| 1170736 | 12/1969 | United Kingdom | 108/51.3 |

*Primary Examiner*—William E. Lyddane

*Attorney, Agent, or Firm*—August E. Roehrig, Jr.; Harold H. Flanders

[57] ABSTRACT

A pallet is disclosed which is particularly adapted for supporting in stacked relation thereon groups of articles so as to facilitate fork lift handling and which is fabricated by cutting, scoring and folding a generally rectangular sheet of foldable material, such as, paperboard, or the like, so as to provide a supporting platform with a center portion depressed, or recessed, and forming an upwardly opening pocket, into which, one or more of the articles may be placed, and having a peripheral sidewall extending below the bottom face of the platform which sidewall is spaced from the perimeter of the platform a sufficient distance to provide clearance for the entry of the fork lift arms when the pocket formation is resting on a surface on which the fork lift is operable.

9 Claims, 15 Drawing Figures

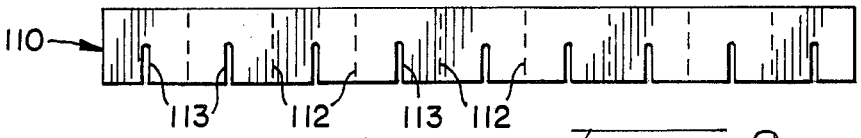
FIG. 9
FIG. 1
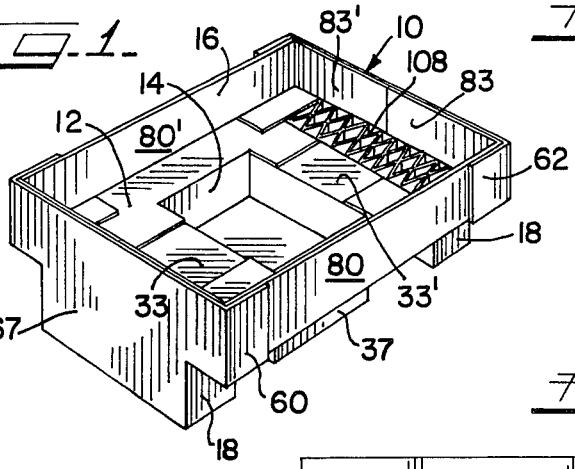
FIG. 3
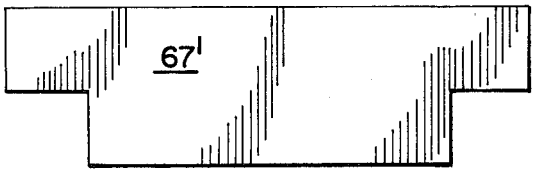
FIG. 2
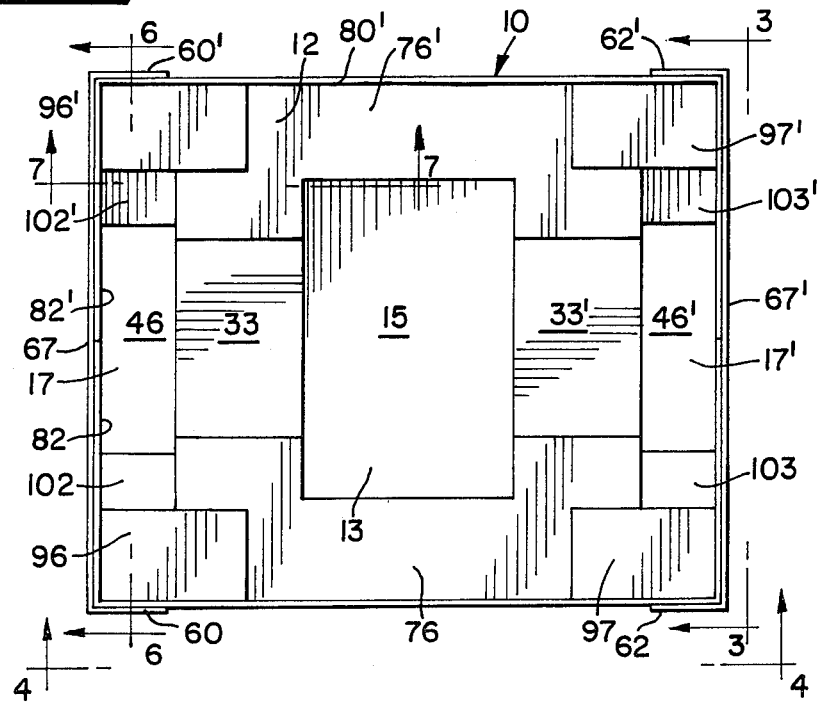

60
60'
62
62'
63
64
67
67'
76
76'
80
80'
82
82'
84
84'
94
94'
96
96'
102
102'
15
17
33
33'
37
37'
46
46'
65
65'

FOLDING PALLET

BACKGROUND OF THE INVENTION

This invention relates in general to article supporting structures, and in particular, to article supporting structures which are adapted for use in connection with the handling of articles in relatively large numbers or of large size. More specifically, but without restriction to the particular use which is shown and described, this invention relates to improvements in a pallet of the type which is adapted for handling by a fork-lift truck.

Pallets for storing and transporting quantities of articles or material have generally been provided in the form of wooden platform structures or frames, which may have bottom rails, or the like, for raising the major portion thereof above the supporting surface so that the fork of a lift truck can be positioned beneath the platform portion. While such devices are satisfactory for handling many articles and materials, they greatly exceed the requirements for strength and durability. In addition, handling and storing quantities of the empty pallets, and maintaining them in repair, frequently results in an unanticipated increase in costs. Consequently, there has been a need for a less costly pallet which will afford greater convenience in handling certain materials, particularly, bagged or boxed materials, such as, for example, carbon black, which heretofore has been palletized on expensive wooden pallets.

SUMMARY OF THE INVENTION

It is a general object of the invention, therefore, to provide a relatively inexpensive article supporting pallet structure which is formed from a foldable sheet material, such as paperboard of suitable weight or gauge, and which is constructed so as to be most conveniently handled by a fork-lift truck.

A more specific object of the invention is to provide a pallet structure for supporting and conveying articles on a fork-lift truck wherein the pallet is formed by cutting, scoring and folding a sheet of paperboard, or similar foldable sheet material, so as to provide an article supporting platform having a central recess for accommodating a portion of the load therein with the perimeter of the recess spaced inwardly of the perimeter of the platform a sufficient distance to permit the fork arms of the lift truck to be inserted beneath the platform when the pallet and lift truck are on a common supporting surface.

A further object of the invention is to provide a pallet structure adapted for supporting articles, such as bagged or boxed materials, wherein the pallet comprises an article supporting platform, having an upwardly opening central recess which is defined by depending peripheral side walls, and a bottom wall, which recess is adapted to accommodate a quantity of the articles and to cooperate with surrounding areas of the platform in supporting additional articles in stacked relation thereon, with the side walls depending a sufficient distance to provide downwardly opening recesses in the form of end opening channels into which the fork arms of a fork-lift truck may be inserted from any side of the platform when the pallet and lift truck are resting on a common surface.

To this end the invention as claimed is embodied in an article supporting pallet structure which comprises an article support in the form of a platform having an upwardly opening central recess, defined by depending peripheral side walls and a bottom wall on which the pallet may rest, with the side walls spaced inwardly of the periphery of the platform a sufficient distance to enable the arms of a fork lift-truck, which is operating on a common supporting surface, to be positioned in lifting relation beneath portions of the platform adjoining the recess.

The foregoing and other objects and advantages of the invention will become more apparent when reference is made to the accompanying detailed description of the preferred embodiments of the invention which is set forth in the drawings wherein like reference numerals indicate corresponding parts throughout.

DESCRIPTION OF THE DRAWINGS

FIG. 1 is a perspective view of a pallet structure which embodies the principle features of the invention;

FIG. 2 is a plan view of the pallet structure of FIG. 1, to a larger scale;

FIG. 3 is an end elevation of the pallet of FIG. 1, the view being taken on the line 3—3 of FIG. 2;

FIG. 9 is an elevational view of a strip of paperboard material which is cut and scored for forming a filler shown in the end recesses in the pallet of FIG. 1;

DESCRIPTION OF THE PREFERRED EMBODIMENTS

Figures 4, 5, 6, 7:
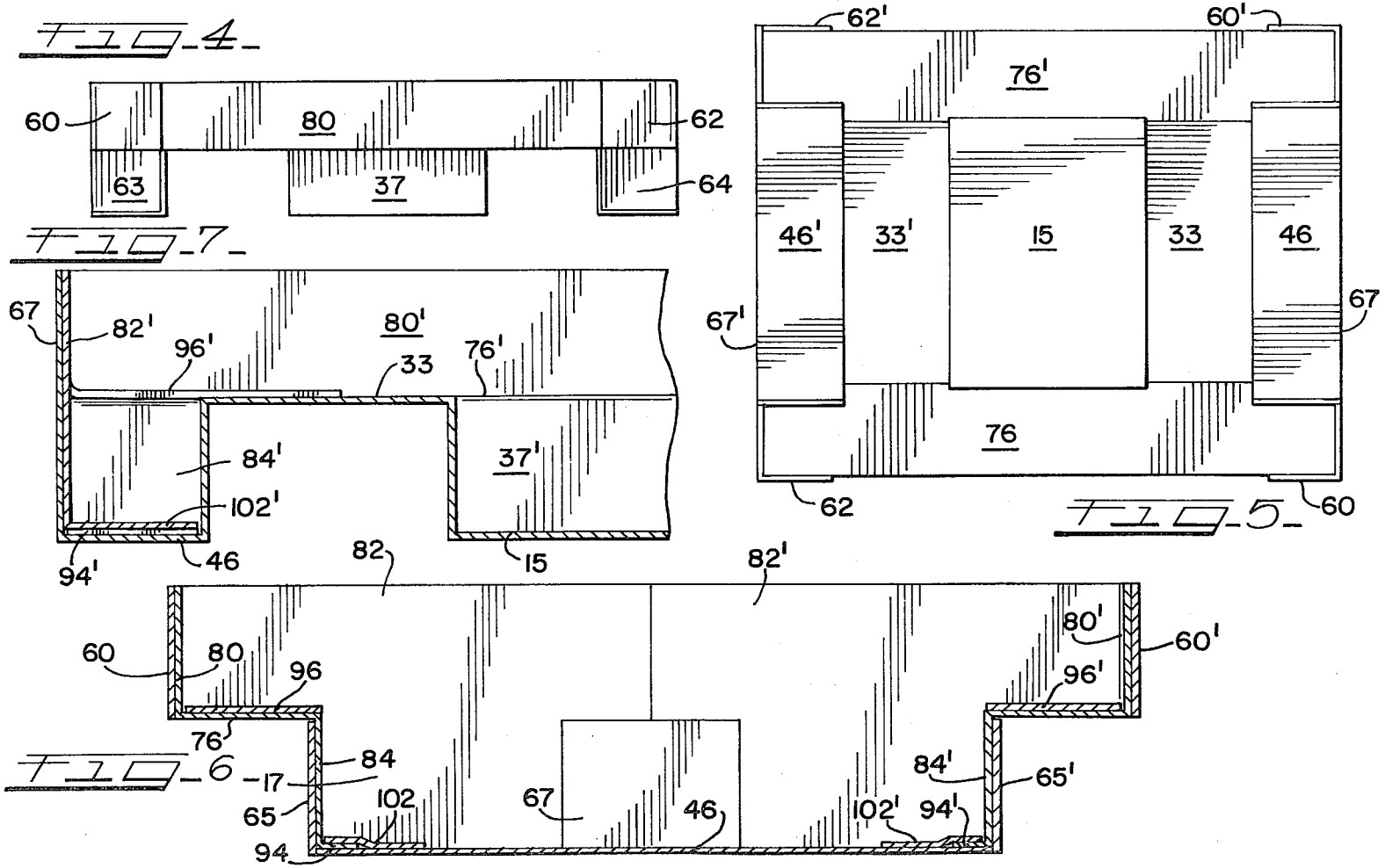
FIG. 4 is a side elevation of the pallet of FIG. 1, the view being taken on the line 4—4 of FIG. 2.
FIG. 5 is a bottom plan view of the pallet as shown in FIG. 2.
FIG. 6 is a cross sectional view, to a larger scale, the view being taken on the line 6—6 of FIG. 2.
FIG. 7 is a fragmentary cross sectional view, to a larger scale, the view being taken on the line 7—7 of FIG. 2.

Referring to FIGS. 1 to 6 the pallet 10, which has a rectangular configuration in the preferred form thereof, comprises a rectangular platform arrangement 12 constituting an article support with an upwardly opening central recess 13, the latter being formed by a peripheral side and end wall structure 14 depending from the platform 12 to a rectangular bottom wall structure 15. At the outer perimeter of the platform 12 there is an upstanding side and end wall structure 16 and relatively narrow rectangular recesses 17 and 17' of the same depth as the center recess 13 are provided at opposite ends of the platform 12 by depending wall structures 18 and 18'. The wall structures 18 and 18' are spaced from the wall structure 14, which defines the center recess 13, a sufficient distance to permit the fork arms of a lift truck to be inserted in the resulting channels. The vertical wall formations defining the center recess 13 and the two end recesses 17 and 17' are terminated short of the outer perimeter of the platform structure 12 so as to enable the positioning of the arms of the lift truck beneath opposite side margins of the platform 12, which may be seen from the views in FIGS. 1 and 3.

Figure 8:
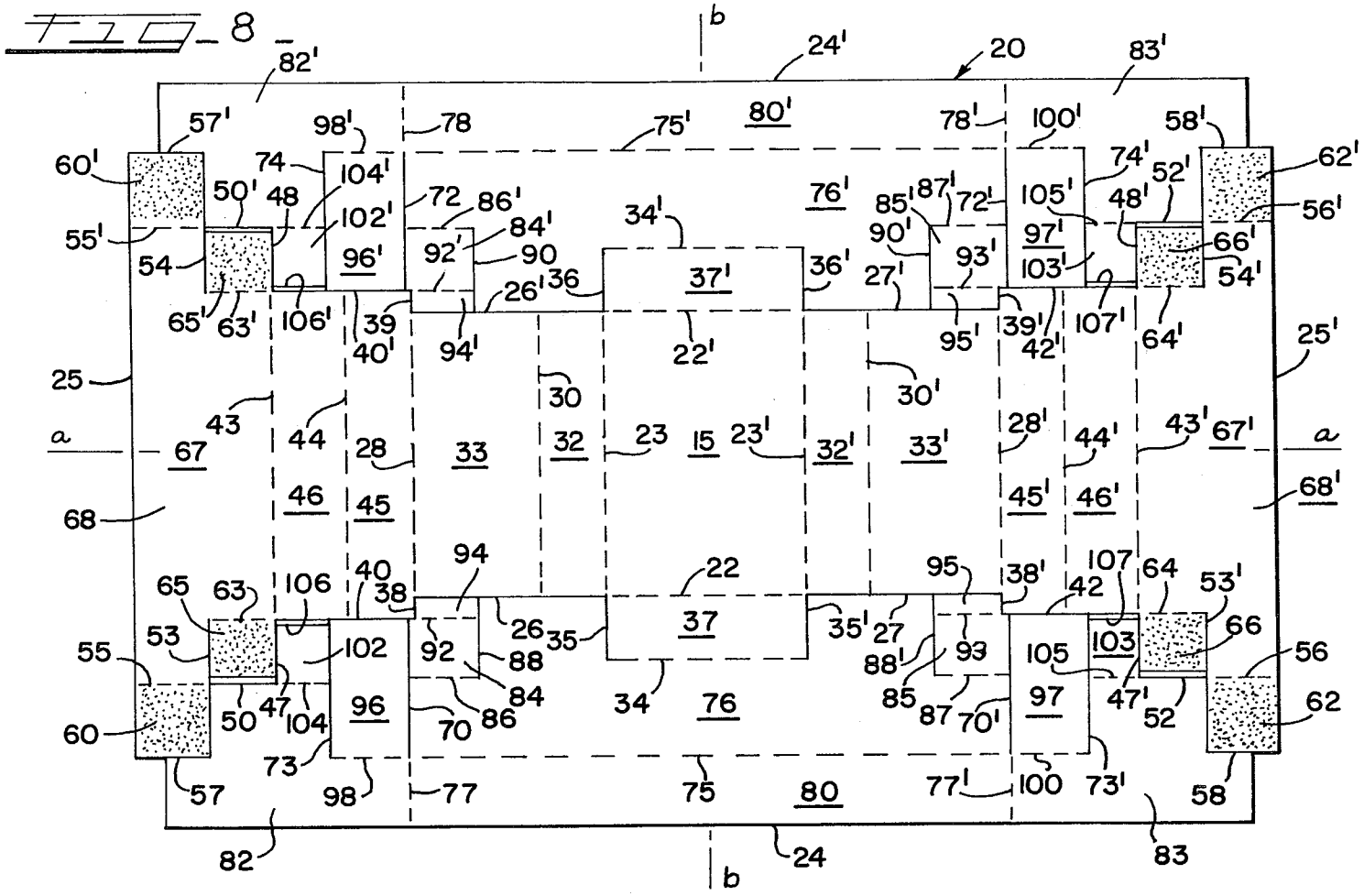
FIG. 8 is a plan view of a paperboard blank which is cut and scored preparatory to forming the pallet of FIG. 1.

Referring to FIG. 8, there is illustrated a blank 20 which may be formed from folded paperboard, or similar material, of a suitable weight, or gauge, for supporting the articles for which the pallet is intended to be used. The blank 20 is cut and scored so as to be folded and glued, as hereinafter set forth, to form the pallet structure 10 in FIG. 1. The blank 20 is cut and scored so that it is symmetrical about longitudinal and transverse center lines a—a and b—b. Consequently, each of the four quarter sections of the blank is cut and scored so as to divide each of such sections into a set of panel portions of like size and configuration, which together provide the required panel elements for fabricating the pallet. The center portion of the blank is scored on pairs of transversely spaced parallel score lines 22, 22' and longitudinally spaced parallel score lines 23, 23' with the score lines of each pair thereof equally spaced from the side and end edges 24, 24' and 25, 25', respectively, of the blank and the lines of each pair thereof being equally spaced on opposite sides of the center lines a—a and b—b, so as to define a bottom wall forming panel 15. Cutting lines 26, 26' and 27, 27' extend in alignment with score lines 22 and 22' at opposite ends of the latter and in the direction of the opposite ends of the blank, to parallel transverse score lines 28 and 28' which are equally spaced from the transverse center line b—b. The sections of the blank between the score lines 23 and 28 and between 23' and 28' are divided in an identical manner by parallel transverse score lines 30 and 30' into relatively narrow panels 32, 32' and somewhat wider panels 33, 33'. The panels 32, 32' constitute oppositely disposed portions of the depending side wall structure 14 (FIG. 1) which defines the periphery of the center recess 13, and the panels 33, 33' constitute panel portions of the platform structure 12 which extend on the sides and adjoin the center recess 13 (FIG. 2). Longitudinally extending score lines 34 and 34' are spaced equal distances outboard of the score lines 22 and 22', and extend between the outboard ends of pairs of short longitudinally spaced cutting lines 35, 35' and 36, 36' which form end extensions of the score lines 23 and 23' and extend from the ends of the score lines 22 and 22' to the ends of the score lines 34 and 34', so as to define, with the parallel score lines 22 and 22', rectangular panels 37 and 37' which are dimensioned to form, with the rectangular panels 32 and 32' the depending wall structure 14 which defines the periphery of the center recess 13. The transverse score lines 28 and 28' have short transversely aligned cutting lines 38, 39 and 38', 39' at their opposite ends which extend transversely of the blank to the inner ends of parallel, transversely spaced, longitudinal cutting lines 40, 40' and 42, 42' which are offset outwardly of cutting lines 26, 26' and 27, 27' a short distance and which terminate at their outer ends at the ends of transverse score lines 43 and 43', the latter being parallel with and spaced a predetermined longitudinal distance from the transverse score lines 28 and 28'. The blank sections thus defined between the transverse score lines 28, 43 and 28', 43' are divided by parallel, transverse score lines 44 and 44' so as to form rectangular panels 45, 46 and 45', 46' extending between the longitudinal cutting lines 40, 40' and 42, 42'. The panels 45 and 45' have a dimension longitudinally of the blank corresponding to the like dimension of the panels 32 and 32' in the same direction. The corresponding dimension of the panels 46 and 46' is somewhat greater than that of the panels 45 and 45', in the form shown. The dimension of the panels 45, 46 and 45', 46' in the direction transversely of the blank is slightly greater than the corresponding dimension of the panels 32 and 32'. The panels 45 and 45' are adapted to form the innermost wall of the recesses 17 and 17' (FIG. 2) while the panels 46 and 46' are adapted to form the bottom wall or floor of the recesses 17 and 17'. Relatively short cutting lines 47, 48 and 47', 48' extend from the outermost ends of the cutting lines 40, 40' and 42, 42' which are aligned transversely of the blank with the transverse score lines 43 and 43' and extend outwardly of the ends thereof to the innermost ends of relatively short longitudinal cutting lines 50, 50' and 52, 52', the outermost ends of which terminate at a midpoint of transverse cutting lines 53, 54 and 53', 54'. Relatively short longitudinal score lines 55, 55' and 56, 56' which align with cutting lines 50, 50' and 52, 52', extend from the transverse cutting lines 53, 54 and 53', 54' to the end edges 25 and 25' of the blank. Relatively short longitudinal cutting lines 57, 57' and 58, 58' extend from the outermost ends of the transverse cutting lines 53, 54 and 53', 54' to the terminal end edges 25 and 25' of the blank. The cutting lines 57, 57' and 58, 58' are offset outwardly of the parallel score lines 55, 55' and 56, 56' so as to form corner connecting glue tabs 60, 60' and 62, 62' which hinge on score lines 55, 55' and 56, 56'. Short longitudinal hinge forming score lines 63, 63' and 64, 64' extend between the innermost ends of the cutting lines 53, 54 and 53', 54' and the innermost ends of cutting lines 47, 48 and 47', 48' which are aligned with the longitudinal cutting lines 40, 40' and 42, 42'. The line 63, 63' and 64, 64' define the hinge lines of glue tabs 65, 65' and 66, 66' which glue tabs or glue panels are freed by the associated cutting lines and are adapted to form the outermost end panels at the ends of recesses 17 and 17'. The glue tabs 60, 60' and 62, 62' lie at opposite ends or sides of the end panels 67 and 67' which extend from the score lines 43 and 43' to the blank end edges 25 and 25'. At the opposite ends of the blank, the blank sections 68 and 68' which provide the panels 32, 33, 45, 46, 67 and 32', 33', 45', 46', 67' are freed by the associated longitudinal and transverse cutting lines at their opposite sides so that these panel forming sections may be hinged about the longitudinally spaced transverse score lines 23 and 23' which define the oppositely disposed edges of the bottom wall forming panel 15 of the center recess 13. In addition, the panels into which these sections of the blank are divided are adapted to be hinged about the associated transverse score lines 30, 28, 44, 43 and 30', 28', 44', 43' to form portions of the platform structure 12 (FIG. 1); the end recesses 17, 17' and the outer end wall panels.

The opposite side margins of the blank 20 are divided by cutting and scoring into side wall forming panels and, at each end of the side wall panels, a corner connecting and reinforcing panel arrangement which is adapted to be hinged so as to bring the major portion into double panel end wall forming relation with the end wall forming panels 67, 67'. The side marginal material is cut on the parallel transverse lines 70, 72 and 70', 72' which are longitudinally spaced and which are equidistant from the transverse center line b—b. The cutting lines 70, 70' and 72, 72' extend from adjacent the innermost ends of longitudinal cutting lines 40, 40' and 42, 42' and are located in transverse planes which are offset a small distance outwardly, in the direction of the ends of the blank, from the transverse planes in which the hinge score lines 38, 39 and 38', 39' lie. Transverse cutting lines 73, 74 and 73', 74' extend in parallel, longitudinally spaced relation to the lines 70, 72 and 70', 72' from points intermediate the ends of longitudinal cutting lines 40, 40' and 42, 42' to the opposite ends of parallel longitudinal hinge score lines 75 and 75'. The cutting lines 70, 72 and 70', 72' terminate at the score lines 75 and 75', with the latter being parallel with, and spaced equidistant from, the longitudinal hinge score lines 34 and 34' and lie a predetermined distance inwardly of the side edges 24 and 24' of the blank. The portions thereof extending between the cutting lines 70, 72 and 70', 72' constitute the outside edges of the panels 76 and 76' which form side portions of the article supporting platform structure 12 (FIGS. 1 and 2) of the pallet 10. Score lines 77, 77' and 78, 78' forming aligned extensions of the cutting lines 70, 70' and 72, 72' define the opposite ends of relatively narrow side wall panels 80, 80' which are adapted to hinge into upright position on the score lines 75 and 75' in the pallet 10 (FIG. 1) and form part of the side wall structure 16. The score lines 77, 77' and 78, 78' also constitute corner forming hinge lines for corner portions or sections 82, 82' and 83, 83' of the blank which are freed from the panels 45, 46, 67 and 45', 46' and 67' by the same cutting lines which free the end sections 68 and 68' of the blank as heretofore described. The panels 76 and 76' are cut and scored at the inside corners to provide small panels 84, 84' and 85, 85' which are freed to hinge about short, longitudinally extending parallel score lines 86, 86' and 87, 87' which score lines extend between the outermost ends of short, transverse cutting lines 88, 90, and 88', 90' and points on the cutting lines 70, 72 and 70', 72' intermediate the ends of the latter. Longitudinal, parallel hinge forming score lines 92, 93 and 92', 93', which are aligned with the cutting lines 40, 40' and 42, 42' and which extend between the inner ends thereof to the transverse cutting lines 88, 90 and 88', 90', set off, at the freed ends of the panels 84, 84' and 85, 85', small tab forming panels 94, 94' and 95, 95' which are adapted to be glued to the ends of bottom wall forming panels 46 and 46' when the panels 84, 84' and 85, 85' are folded into end wall forming relation with the inner end wall forming panels 65, 65' and 66, 66' to which they are glued in forming the end walls of the recesses 17 and 17' in the pallet (FIGS. 4, 6 and 7). The corner sections 82, 82' and 83, 83' of the blank which are freed in part by cutting on the parallel transverse lines 73, 74 and 73', 74' are divided by the cutting and scoring lines to provide rectangular panels 96, 96' and 97, 97' for hinging about the score lines 98, 98' and 100, 100' which extend at the ends of the longitudinal score lines 75, 75'. The panels 96, 96' and 97, 97' constitute anchoring and reinforcing panels for adhesively securing on the top face of the platform side panels 76 and 76' (FIG. 2). The cutting lines 73, 74 and 73, 73' together with the cutting lines 47, 48 and 47', 48' free small panels 102, 102' and 103, 103' for hinging about longitudinal score lines 104, 104' and 105, 105' which are aligned with and extend inwardly of the inner ends of cutting lines 50, 50' and 52, 52', with the free ends cut back slightly on the longitudinal cutting lines 106, 106' and 107, 107'. The panels 102, 102' and 103, 103' are adapted to be folded on the hinge lines 104, 104' and 105, 105', in setting up the pallet, so as to lie on the ends of the bottom wall forming panels 46 and 46' for the recesses 17 and 17' and to be adhesively secured thereto when the inner end wall forming panel sections 82, 82' and 83, 83' are folded about the hinge score lines 77, 78 and 77', 78' so as to lie along the inside of the end wall forming panels 67 and 67' to which they are secured by an adhesive or other fastening means.

In setting up the pallet 10 from the cut and scored blank 20 of FIG. 8 an adhesive is applied to the uppermost faces of the panels 60, 60'; 62, 62' and 65, 65'; 66, 66' on the ends of panels 67 and 67'. Adhesive is applied to the bottom faces of the portions of the platform side panels 76 and 76' which lie adjacent the cutting lines 35, 36 and 35', 36'. An adhesive is applied also to the bottom faces of the panels 96, 96'; 97, 97' and to the bottom faces of panels 102, 102' and 103, 103'. The panels 32, 33 and 45 on one side and 32', 33' and 45' on the other side are first folded to bring the panels 32, 32' into upright relation to the bottom wall forming panel 15 of the central recess, with the panels 33, 33' in a plane parallel to the plane of the panel 15 and at an upper level in which the platform is operative. The panels 45 and 45' are turned down to form the inner walls of the end recesses 17 and 17'. The side platform panels 76 and 76' are then swung upwardly and inwardly to bring the panels 37 and 37' into upright end wall forming relation to the bottom wall forming panel 15 with the innermost portions of panels 76 and 76' overlying the ends of the panels 33, 33' as shown in FIG. 2 and adhesively secured in position. The small panels 84, 84' and 85, 85' may then be turned down and the tab panels 94, 94' and 95, 95' secured on the top end margins of the panels 46 and 46'. The inner end wall forming panels 82, 82' and 83, 83' are swung about the hinge scores 77, 78 and 77', 78' into a right angle position relative to the panels 80 and 80' after which the panels 80 and 80' are swung about the hinge score lines 75 and 75' to an upright position relative to the panels 76 and 76'. The panels 96, 96' and 97, 97' are swung about the hinge lines 98, 98' and 100, 100' so that they are brought into overlying relation with end portions of the panels 76 and 76' while the panels 102, 102' and 103, 103' are swung about the hinge lines 104, 104' and 105, 105' so that they are brought into overlying relation with the end margins of bottom wall forming panels 46 and 46' and the tabs 94, 94' and 95, 95' where they are adhesively secured in position. The panels 67 and 67' are swung up into end wall position on the hinge scores 43 and 43' and adhesively secured to the inner end wall panels 82, 82' and 83, 83'. The small panels 60, 60' and 62, 62' are folded into engagement with the end margins of the panels 80, 80' and adhesively secured. The small panels 65, 65' and 66, 66' are folded into engagement with the panels 84, 84' and 85, 85' and adhesively secured which completes the assembly of the pallet.

In handling some products it may be desirable or convenient to provide a filler 108 (FIG. 1) in the end recesses 17 and 17'. This may be provided by cutting and scoring pairs of elongate strip material as shown at 110 in FIG. 9. Each strip 110 is transversely scored on parallel equally spaced lines 112 and provided with equally spaced transverse slots 113 intermediate each pair of the score lines and extending inwardly from a common longitudinal edge approximately half the width of the strip. A pair of the strips 110 may then be accordion folded and interconnected in a well known manner to provide a filler 108 as shown in FIG. 1, the filler strips being dimensioned so as to position the grid-like uppermost face formed by the edges of the strips in the plane of the platform panels 33 and 33' adjoining the recess.

Figure 10:
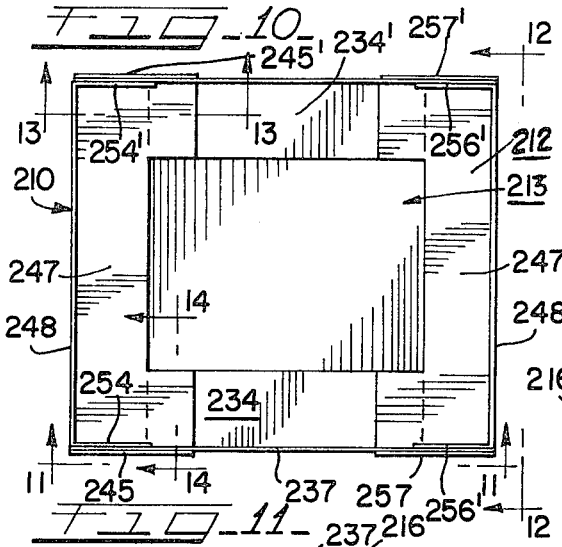
FIG. 10 is a top plan view of a modified form of pallet.
Figure 12:
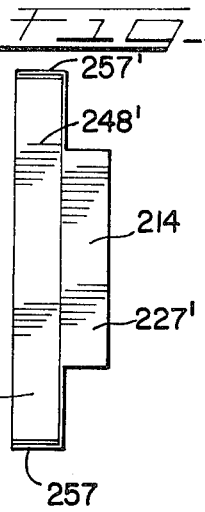
FIG. 12 is an elevational view showing an end of the pallet of FIG. 10.
Figure 11:
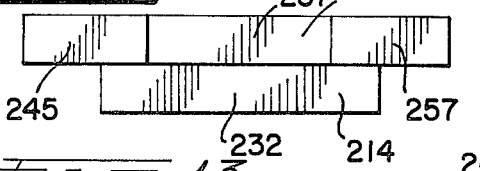
FIG. 11 is an elevational view showing a side of the pallet of FIG. 10.
Figure 13:
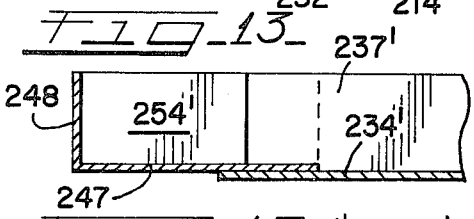
FIG. 13 is a fragmentary sectional view taken on line 13—13 of FIG. 10 to an enlarged scale.
Figure 14:
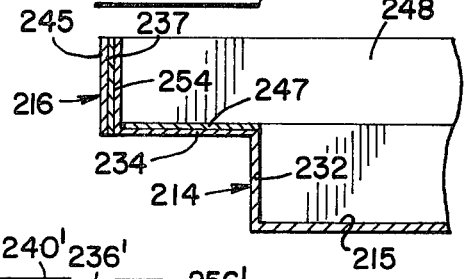
FIG. 14 is a fragmentary sectional view taken on the line 14—14 of FIG. 10 to an enlarged scale.

A modified pallet arrangement is illustrated at 210 in FIGS. 10 and 14 which provides an article supporting platform surface 212 with a center recess 213 having a depending peripheral side and end wall structure 214 and a bottom wall 215. A peripheral side wall structure 216 is upstanding at the outer edges of the platform. The center recess is of relatively large dimensions so as to provide adequate stability when the pallet is resting on a surface and loaded so that the weight is not evenly distributed on the platform 212. In the form shown, the rectangular center recess 213 has its longest dimension in the same direction as the corresponding dimension of the pallet. The pallet may, of course, be square.

Figure 15:
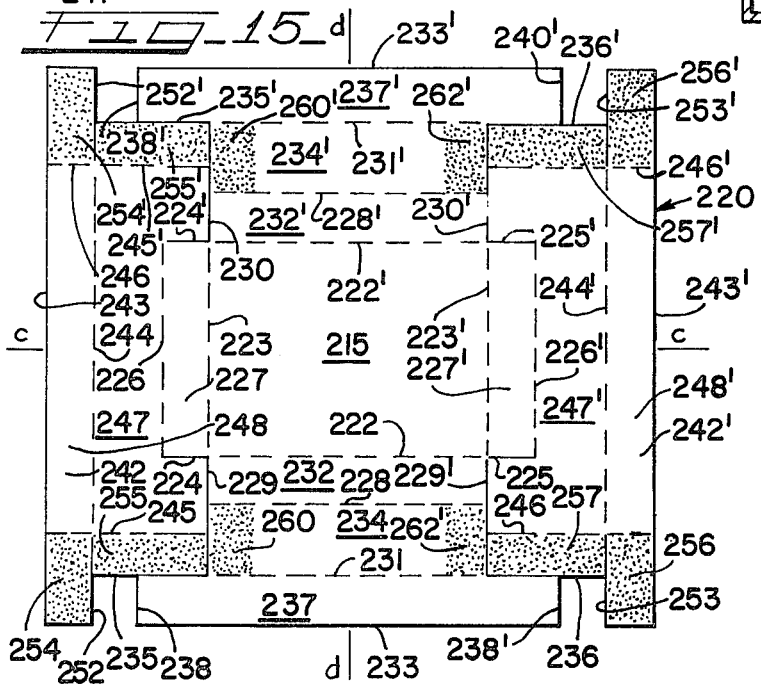
FIG. 15 is a plan view showing a paperboard blank which is cut and scored preparatory to forming the pallet of FIG. 10.

The pallet 210 is formed from a paperboard blank 220 which is cut and scored as shown in FIG. 15. The cut and scored blank is symmetrical about the longitudinal and transverse center lines c—c and d—d and each of the four sections of the blank is divided by cutting and scoring in an identical manner so as to divide the material into like panel elements for cooperation in forming the pallet structure. A pair of longitudinally extending parallel score lines 222, 222' are equally spaced on opposite sides of the center line c—c and connect the ends of a pair of transversely extending parallel score lines 223, 223' which are equally spaced on opposite sides of the transverse center line d—d, so as to define the edges of the recess 213 and the perimeter of a panel 215 for forming the bottom wall of the recess. Relatively small cutting lines 224, 224' and 225, 225' extend in alignment with the score lines 222 and 222' and outwardly from the ends of the score lines 226 and 226', the latter being spaced outwardly of the transverse score lines 223 and 223' a distance which determines the depth of the center recess 213. At one end of the panel 215 the score lines 223, 226 and cutting lines 224, 224' define the wall forming panel 227 while at the opposite end of panel 215 the corresponding scoring and cutting lines 223', 226' and 225, 225' define a like wall forming panel 227' for the recess 213. Parallel longitudinal score lines 228 and 228' are spaced outwardly of the score lines 222 and 222' a distance corresponding to the distance between the score lines 223, 226 and 223', 226' and extend between pairs of cutting lines 229, 229' and 230, 230' which cutting lines extend in alignment with the transverse score lines 223 and 223' and outwardly of the ends thereof. The scoring and cutting lines 222, 228, 229, 229' and 222', 228', 230, 230' define side wall panels 232 and 232' for cooperation with the panels 215, 227 and 227' in forming the center recess 213. The cutting lines 229, 229' and 230, 230' extend transversely of the blank from the ends of the longitudinal score lines 222 and 222' to the ends of parallel longitudinal score lines 231 and 231' which are spaced intermediate the parallel score lines 228 and 228' and the side edges 233 and 233' of the blank. The score lines 231 and 231' which extend between the outer ends of the longitudinally spaced pairs of transverse cutting lines 229, 229' and 230, 230', cooperate with the latter and the score lines 228 and 228' in defining platform panels 234 and 234'. At opposite ends of the score lines 231 and 231' the blank material is cut on the longitudinal Lines 235, 236 and 235', 236' which extend outwardly of the ends and in alignment with the longitudinal score lines 231 and 231'. These cutting lines together with the transverse cutting lines 238, 238' and 240, 240' free the side wall forming panels 237 and 237' for hinging about the score lines 231 and 231'. The adjoining platform panels 234 and 234' are freed by the cutting lines 229, 229' and 230, 230' for hinging about the score lines 228, 222 and 228', 222'. The end sections 242 and 242' at opposite ends of the blank, are freed by the cutting lines 229, 230, 235, 235', 238, 238' and the cutting lines 229', 230', 236, 236', 240, 240' for hinging movement about the transverse score lines 223, 226 and 223', 226', with the panels 227 and 227' being freed to serve as hinge panels by the cutting lines 224, 224' and 225, 225'. These end sections 242 and 242' of the blank are divided by parallel, transversely extending score lines 244 and 244' and associated pairs of transversely spaced longitudinally extending score lines 245, 245' and 246, 246' into platform panels 247, 247' and end wall panels 248, 248', together with small corner connecting panels at each end thereof. Cutting lines 252, 252' and 253, 253' extend from opposite ends of the score lines 244 and 244' outwardly in alignment with the latter and divide the material outboard of the longitudinal score lines 245, 245' and 246, 246' into small rectangular panels 254, 255 and 254', 255' at the opposite ends of the blank section 242 and panels 256, 257 and 256', 257' at opposite ends of the blank section 242'. The transverse cutting lines 252, 252' and 253, 253' which extend from opposite ends of the score lines 244 and 244', are spaced longitudinally from the parallel cutting lines 238, 238' and 240, 240' a distance longitudinally of the blank corresponding to the distance between the score lines 223, 226 and 223', 226'. The panels 255, 255' and 257, 257' at the ends of panels 247 and 247' have a dimension transversely of the blank which corresponds to the transverse dimension of the top side wall forming panels 237 and 237'. The innermost end portions of score lines 245, 245' and 246, 246' are cut through a distance longitudinal of the blank which equals the distance between the score lines 223, 226 and 223', 226'.

In forming the pallet 210 from the cut and scored blank 220, the side panels 232, 234, 237 and 232', 234', 237' are folded about the score lines 222, 228, 231 and 222', 228' and 231' to bring the panels 232 and 237 into upstanding position relative to the panels 215 and 234 at the one side of the blank, with the corresponding panels at the other side of the blank being folded in like manner to a like position. The end panel sections 242 and 242' are then folded about the score lines 223, 226 and 223', 226' to bring the panels 227 and 227' into upstanding position and to move the portions of panels 247 and 247' which are adjacent to the cutting lines 224, 224' and 225, 225' into overlying relation with end marginal portions of the platform panels 234, 234' which have been preglued on the top faces thereof as indicated at 260, 262 and 260', 262'. The top wall forming panels 248 and 248' are hinged about the score lines 244 and 244' into upright position and the corner connecting panels 254, 254' and 256, 256' which have been preglued on the top face are hinged about the score lines 245, 245' and 246, 246' so as to lie on the outside of the ends of the top side wall panels 237 and 237'. The panels 255, 255' and 257, 257' which are preglued are swung to upright position about the hinge score lines 245, 245' and 246, 246' to bring these panels into adhesive engagement with the end margins of the panels 237 and 237' where they overlie the panels 254, 254' and 256, 256'.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A pallet structure for supporting articles so as to facilitate handling and transporting by a fork lift truck which pallet structure is formed from a cut and scored blank of relatively heavy weight paperboard, or like foldable sheet material, said structure comprising an article supporting platform arrangement having a central portion thereof depressed so as to provide a pocket-forming, article-accommodating recess which is defined by a sidewall structure and a bottom wall structure, said sidewall structure comprising panels depending from the plane of the surrounding platform area to the perimeter of said bottom wall structure, which bottom wall structure is disposed in a plane a substantial distance below the bottom face of the surrounding platform area and said sidewall structure being spaced inwardly of the outermost edges of said platform structure on all sides a sufficient distance to permit the arms of a fork lift to be inserted from any adjoining sides of the pallet so as to engage in supporting relation beneath the platform while the bottom wall of the recess is resting on a supporting surface at a level below the bottom face of the platform, said platform arrangement including an upstanding rim forming arrangement at its outer edges.

2. A pallet structure as set forth in claim 1 wherein said platform arrangement includes panel portions at opposite sides of said center recess which are connected in integrally hinged relation with panel members forming portions of the depending wall structure at the perimeter of said center recess, with a pair of said platform panel portions each having integral portions thereof extending adjacent the hinged connection with said depending wall structure which extending portions overlap and are secured to end portions of the adjoining platform panel portions.

3. A pallet structure as set forth in claim 1 wherein said upstanding rim forming arrangement comprises a continuous rim and which comprises, in part, narrow panels hinged at the edge of said platform structure and having corner connecting panels at each end of said narrow wall panels which are secured in overlying relation to the adjoining rim forming panels.

4. A pallet structure for supporting articles so as to facilitate handling and transporting by a fork lift truck which pallet structure is formed from a cut and scored blank of relatively heavy weight paperboard, or like foldable sheet material, said structure comprising an article supporting platform arrangement having a central portion thereof depressed so as to provide a pocket-forming, article-accommodating recess which is defined by a sidewall structure and a bottom wall structure, said sidewall structure comprising panels depending from the plane of the surrounding platform area to the perimeter of said bottom wall structure, which bottom wall structure is disposed in a plane a substantial distance below the bottom face of the surrounding platform area and said sidewall structure being spaced inwardly of the outermost edges of said platform structure a sufficient distance to permit the arms of a fork lift to be inserted from adjoining sides of the pallet so as to engage in supporting relation beneath the platform while the bottom wall of the recess is resting on a supporting surface at a level below the bottom face of the platform, said platform arrangement having portions thereof which are spaced on opposite sides of the center recess and which are depressed so as to form a pair of supplementary recesses which are disposed at opposite edges of said platform, with each of said supplementary recesses spaced from said center recess, and each said supplementary recess having depending inner sidewall forming panels which are parallel with the corresponding sidewall panels of said center recess and spaced therefrom a distance sufficient to permit the arms of a fork lift truck to be positioned in engagement with the bottom face of the platform on opposite sides of said center recess.

5. A pallet structure for supporting articles so as to facilitate handling and transporting by a fork lift truck which pallet structure is formed form a cut and scored blank of relatively heavy weight paperboard, or like foldable sheet material, said structure comprising an article supporting platform arrangement having a central portion thereof depressed so as to provide a pocket-forming, article-accommodating recess which is defined by a sidewall structure and a bottom wall structure, said sidewall structure comprising panels depending from the plane of the surrounding platform area and said sidewall structure being spaced inwardly of the outermost edges of said platform structure a sufficient distance to permit the arms of a fork lift to be inserted from adjoining sides of the pallet so as to engage in supporting relation beneath the platform while the bottom wall of the recess is resting on a supporting surface at a level below the bottom face of the platform, said platform structure being generally rectangular and said platform arrangement having marginal portions on opposite sides of said center recess which are depressed so as to provide pocket-forming side recesses each of which is formed, in part, by a depending inner wall panel and a bottom wall panel with the bottom wall panel disposed in the plane of the bottom wall of the center recess and with said depending inner wall panel spaced from the confronting depending sidewall forming panel of the center recess a distance sufficient to permit insertion of the fork of a fork lift truck which is operating on an adjoining supporting surface.

6. A pallet structure as set forth in claim 5 wherein said pocket-forming side recesses are defined in part by depending outer sidewall panels which are in the plane of upstanding rim forming wall panels at the outer edges of said platform arrangement.

7. A pallet structure as set forth in claim 6 wherein said platform and wall forming panels are hingedly connected on parallel hinge lines.

8. A pallet structure as set forth in claim 5 wherein a filler member in the form of a grid is provided for said side recesses which is constructed from accordion folded strips of paperboard material which are interengaged and positioned on edge in the recess so as to provide for filling the same to the level of the adjoining surface of said platform surface.

9. A cut and scored blank of paperboard or similar material for forming an article handling pallet structure which blank is generally rectangular and which is cut and scored to provide a center section and side sections, which side sections extend lengthwise of the blank and are mirror images of each other, said center section of said blank being divided by transversely spaced, parallel, longitudinal score lines and longitudinally spaced, parallel, transverse score lines which are offset a substantial distance inwardly from all of the corresponding edges of the blank so as to form a central rectangular panel which is adapted to form the bottom wall of a pocket-forming central recess in the pallet structure, said center section of said blank being further divided by longitudinally spaced, transverse score lines located on opposite sides of said central panel so as to provide relatively narrow sidewall forming panels and adjoining platform forming panels, said transverse score lines terminating at their opposite ends at cutting lines which extend in longitudinal alignment at opposite ends of the longitudinally extending score lines defining opposite edges of said central panel, said cutting lines freeing the said sidewall and platform panels from the side sections of the blank, and said side sections of the blank being scored on longitudinal lines which are of equal length and spaced, outwardly of the score lines defining said central panel, a distance corresponding to the dimension, in the longitudinal direction of the blank, of the sidewall forming panels adjoining said central panel in the center section of the blank, which longitudinal lines terminate at opposite ends at the outer ends of transverse cutting lines which extend from the ends of the transverse score lines defining side edges of said central panel.

* * * * *